United States Patent [19]

Rowell

[11] 4,233,832

[45] Nov. 18, 1980

[54] METHOD AND APPARATUS FOR ROLLING METAL WIRE OR ROD INTO WIDE, FLAT STRIPS

[76] Inventor: Douglas W. Rowell, Washington Ave., Woodbury, Conn. 06798

[21] Appl. No.: 6,659

[22] Filed: Jan. 26, 1979

[51] Int. Cl.[3] ..... B21B 1/24

[52] U.S. Cl. ..... 72/91

[58] Field of Search ..... 72/91, 92, 75, 94, 110, 72/111, 184, 199, 366

[56] References Cited

U.S. PATENT DOCUMENTS

| | | | |
|---|---|---|---|
| 260,246 | 6/1882 | Sill | 72/91 |
| 1,217,748 | 2/1917 | Greenfield | 72/91 |
| 1,909,653 | 5/1933 | Brockway | 72/91 |
| 2,787,046 | 4/1957 | Wagstaff | 72/190 |
| 3,013,451 | 12/1961 | Scribner | 72/190 X |
| 3,044,528 | 7/1962 | Wullenwaber et al. | 72/91 |
| 3,143,009 | 8/1964 | Pfeiffer | 72/91 |
| 3,466,911 | 9/1969 | Marcovitch | 72/91 |
| 3,503,237 | 3/1970 | Marcovitch | 72/91 X |
| 3,685,331 | 8/1972 | Marcovitch | 72/190 |
| 4,018,073 | 4/1977 | Bartram et al. | 72/199 |

OTHER PUBLICATIONS

"Wire Flattening"-Nussbaum, Starat Mfg. Co., L. I. City, NY.

"Rolling Flat Non-Ferrous Wire"-Backman, presentation at Annual Convention of the Wire Assn., Oct. 22-25, 1962, Balto, Md.

"Wire Flattening Theory & Practice"-Weber-The Wire Industry, Sep., Oct. & Nov., 1956.

*Primary Examiner*—Milton S. Mehr

*Attorney, Agent, or Firm*—Parmelee, Johnson, Bollinger & Bramblett

[57] ABSTRACT

A metal wire or rod is passed between two rolls one inside the other but with offset axes. The larger outer roll which may be ring-shaped has a smooth inside contact surface. The smaller internal roll has a smooth outside contact surface. Together, these two eccentrically disposed surfaces form a long converging throat between them through which the wire or rod is passed as it is being rolled into a strip. The opposing, smooth surfaces have a separation at the closest point which is less than ⅓ the diameter of the metal wire or rod to be fed between them. The distance between the point where the wire first contacts the opposing, smooth contact surfaces of the converging throat and the closest point of separation between the opposing surfaces is preferred to be at least four times the original diameter "D" of the wire or rod being fed therethrough. The wire or rod is thus progressively nipped between the opposing, smooth contact surfaces in the convergent throat of the two rolls as it passes through thereby flattening the metal since lateral movement and flow of the metal in the convergent throat region is unrestricted while elongation of the metal is restricted by the long converging throat. Rolling of metal wire or rod in this advantageous manner produces a wide, flat metal strip having a width of at least 2.5 times the original diameter "D" of the wire rod, and the resultant strip width may considerably exceed 4.0 times D.

13 Claims, 14 Drawing Figures

60
62
3
68
62
70
72
15
76
10
30
5
5
34
66
66
25
27
35
11
44
11
E
42
70
71
35
64
64
36
30
48
67
67
75
75
74
3

METHOD AND APPARATUS FOR ROLLING METAL WIRE OR ROD INTO WIDE, FLAT STRIPS

BACKGROUND OF THE INVENTION

This invention relates to a method and apparatus for the rolling of metal wire or rod into a wide, flat metal strip having a width at least 2.5 times the original diameter D of the wire or rod which is rolled.

Various metal fabricating and manufacturing operations utilize various widths and lengths of flat metal strips. Many of these metal strips because of their size, length and factors which may relate to the amount of use and the economics of the use, are not manufactured commercially in such sizes but must be cut from larger sheets of the material to the size required. Obtaining the metal strip in this manner by cutting from a wider sheet is both costly and time consuming, particularly where long continuous lengths of such strip are desired. The long strip must be cut from a wide sheet which is coiled and may be difficult to handle because of the width and long lengths of the sheet. Then, the strip must be machined to eliminate the rough edges caused by the slitting operation, when smooth, square or burr-free edges are required.

In order to save continuing repetition of the phrase "wire or rod", the word "wire" as used herein is to be interpreted broadly to include a relatively thick metal wire such as is often called a "rod". As used herein "D" is intended to mean the original diameter of the wire, and "W" is the width of the resultant flat metal strip.

In conventional rolling mill practice it is usually not economical to pass metal wire through the numerous stations of a rolling mill to reduce the cross-sectional area and thus flatten the wire into a metal strip. In a conventional rolling mill the deforming of the metal takes place between an opposed pair of convex rolls in each station causing displacement of the metal to occur mainly longitudinally, i.e. "down the mill", such that the stock becomes progessively lengthened. Only a relatively minor amount of lateral deformation or widening occurs. Thus, the metal at each successive station, and consequently, the rolls in each successive station must be driven at a faster peripheral speed to match the travelling stock. Moreover, in conventional rolling mill practice the width of a strip produced by rolling a metal wire is usually less than 1.5 D. The great investment needed in such multiple-station rolling mill equipment and in the necessary complex drive mechanism is not justified for the rolling of wire into strip of width less than 1.5 D. Consequently, metal strip is usually slit from wide sheet stock as discussed above.

Where there is demand for a flat strip having superior characteristics such as: (1) closer thickness and width tolerances, (2) improved edge shape, (3) reduced strip camber, and (4) smoother surface finish then it is commercially feasible to roll wire into flat strip. The article *Wire-Flattening—An Appraisal of Today's Theory and Practice* by A. I. Nussbaum of the Rolling Mill Division of Stanat Manufacturing Co. of Long Island City, New York sets forth various formulas relating the width of the resultant strip to the initial diameter of the wire for conventional rolling techniques. These formulas and the text of this article support the conclusion expressed above that conventional rolling mill practices produce a strip having a width less than 1.5 D.

A paper entitled *Rolling Flat Non-Ferrous Wire* by G. A. Backman was prepared for presentation to the Annual Convention of The Wire Association, Oct 22-25, 1962, at Baltimore, Maryland. This paper mentions one experiment in which a copper wire having a diameter of 0.005 of an inch was rolled between a pair of convex rolls to produce a strip 0.001 of an inch thick and 0.019 of an inch wide. This is a W/D ratio of 3.8. However, the rolls employed had a diameter 800 times larger than the fine copper wire involved. This 800 ratio is far different from conventional practice and is a totally impractical ratio of roll diameter to wire diameter except for extremely fine wire. In the case of wire, say having a diameter of one-quarter of an inch, each roll diameter would become 200 inches, i.e. sixteen and two-thirds feet in diameter, an unwieldy monstrous pair of rolls.

SUMMARY OF THE INVENTION

It is among the advantages of the present invention that it provides a method and apparatus for rolling a metal wire into a relatively wide, flat strip having a width which is at least 2.5 times the original diameter D of the metal wire in a single rolling station.

An object of this invention is to provide a new and improved method and apparatus for rolling a round wire into a flat metal strip in which substantial widening and flattening of a metal wire is achieved in a single rolling station and without substantially elongated the metal during its deformation into the resultant flat metal strip.

In carrying out this invention in one illustrative embodiment thereof, a metal wire is formed into a relatively wide, flat strip by rolling the wire between two eccentrically mounted rolls one inside the other with one having a smooth internal contact surface and the other having a smooth external contact surface. The rolls are arranged to form a long converging throat between their opposing, smooth contact surfaces with the separation at the closest point between the surfaces being less than $\frac{1}{3}$ the diameter D of the metal wire being rolled therebetween. The rolls are rotated in the same direction, and the metal wire is fed through the long converging throat between the two rolls. The wire is progressively nipped between the opposing, smooth contact surfaces of the two rolls as the wire passes through the converging throat with the lateral movement and flow of the metal being unrestricted while elongation of the wire is restricted by the long converging throat, thereby providing a flat strip which has a width at least 2.5 times the original diameter D of the metal wire.

BRIEF DESCRIPTION OF THE DRAWINGS

The invention, both as to organization and method of operation of embodiments thereof together with further features, aspects and advantages thereof, will become better understood by reference to the following description taken in connection with the accompanying drawings, in which.

DESCRIPTION OF THE PREFERRED EMBODIMENTS

In the description which follows, like elements will have the same reference designations.

Figure 2:
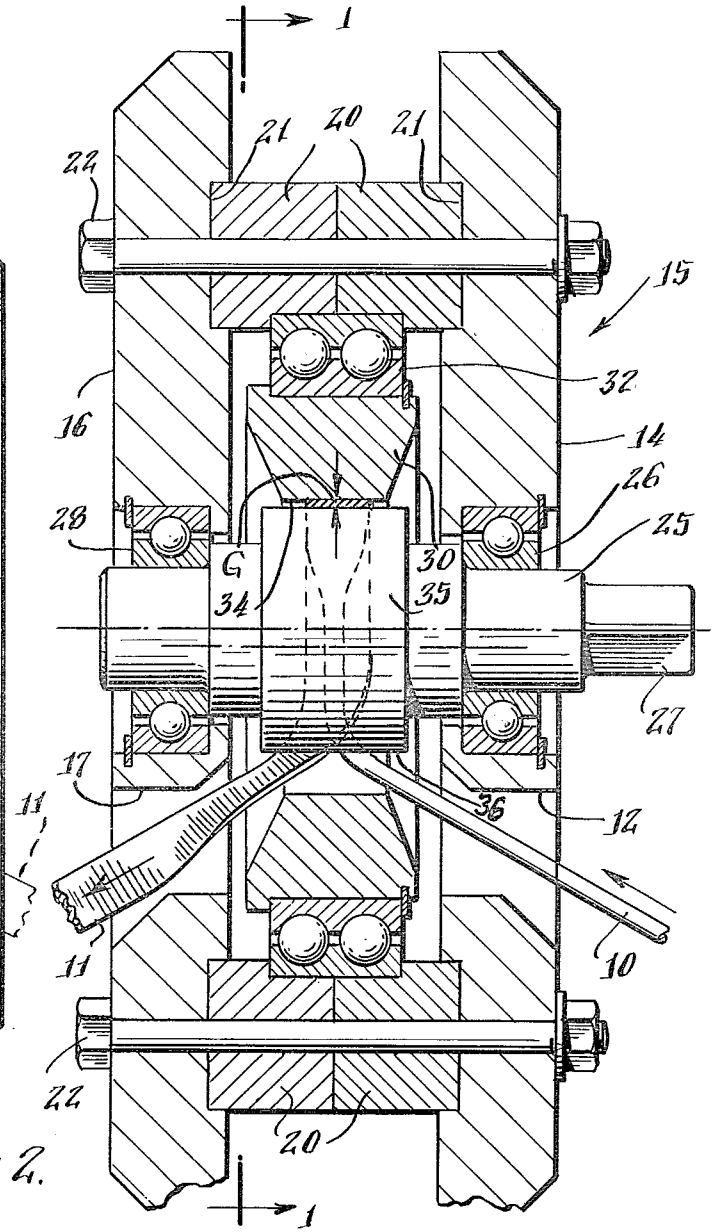
FIG. 2 is an axial sectional view taken along line 2—2 of FIG. 1.
Figure 1:
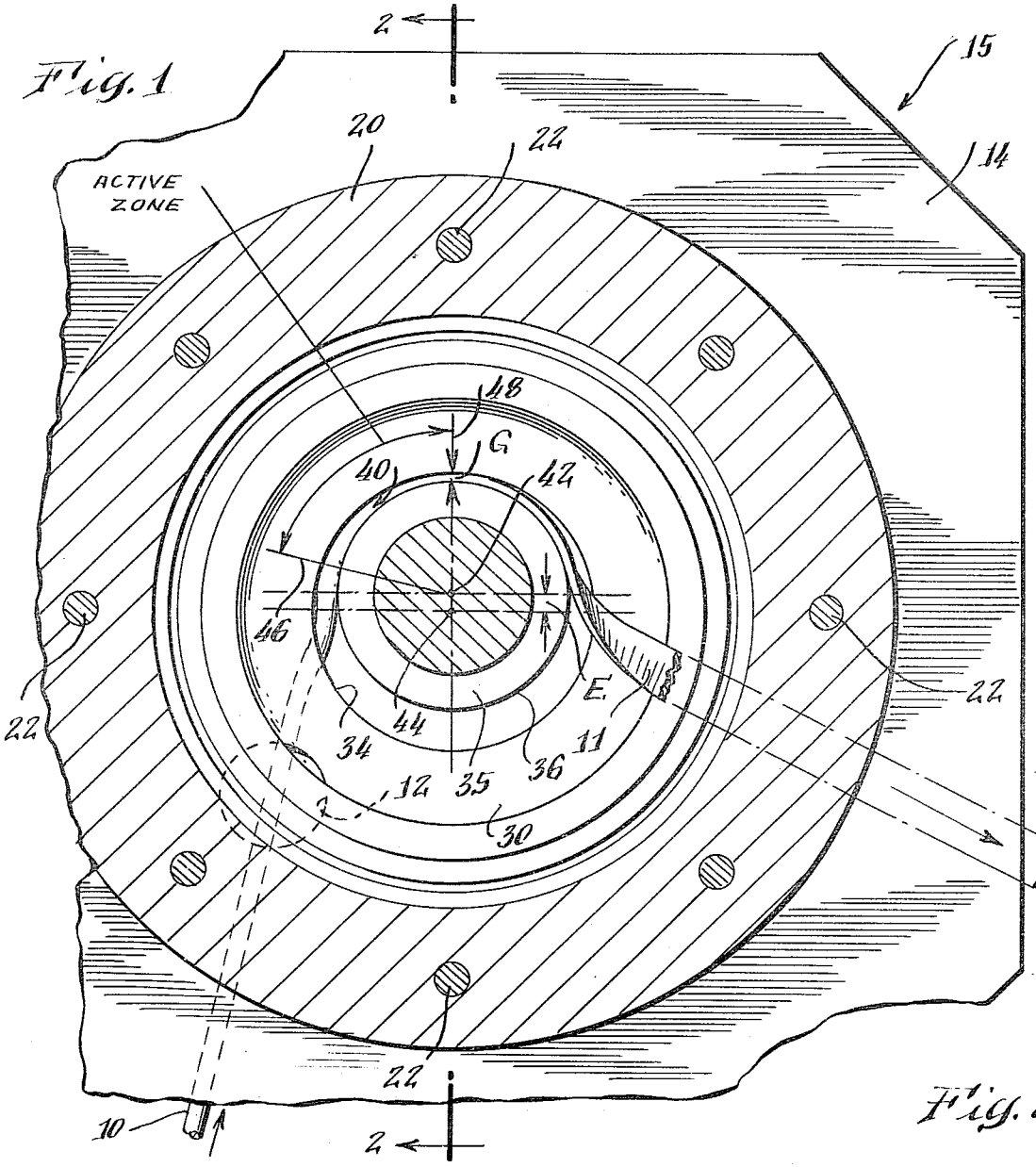
FIG. 1 is a cross-sectional view taken along line 1—1 of FIG. 2 of the type of apparatus which may be employed in one form in practice of this invention.

Referring now to the apparatus shown in FIGS. 1 and 2, a round wire 10 having a diameter D is fed through an entry port 12 of a frame generally designated with the reference numeral 15. The frame 15 is comprised of vertical, parallel, spaced frame members 14 and 16 which are mounted on ring frame members 20 by bolts 22. The ring frame members 20 are formed in two mirror symmetrical elements and seat in an annular recesses 21 in the inner face of each frame member 14, 16. The entry port 12 for the wire 10 is provided in the vertical frame member 14.

A strong, heavy shaft 25 is centrally mounted in the frame 15 for rotation therein on roller bearing 26 and 28 supported in vertical frame members 14 and 16, respectively. The ring frame member 20 carries an outer die roll or die ring 30 for rotation therein by roller bearings 32. The die roll 30 has a smooth interior contact surface 34 thereon.

The shaft 25 carries for rotation therewith an inner die roll 35 which is keyed to this shaft. This inner die roll 35 is shown with an outer, smooth cylindrical contact surface 36 thereon. In this embodiment, the driving torque for rotating the two rolls 30 and 35 is applied to the connection or coupling 27 on the shaft 25. The outer roll 30 is free to rotate, and it is driven by frictional engagement with the metal being deformed between the two rolls. Instead of applying the driving torque to the shaft 25 of the inner roll, this driving torque may be applied directly to the outer roll 30 with the inner roll 35 being free to rotate. One manner in which driving torque may be applied to the outer roll 30 is to connect it to bevelled helical ring gear (not shown) driven by a bevelled helical pinion gear (not shown) having access to this ring gear through a suitable access port in the frame 15. It is the preferred mode, as shown, to drive the shaft 25 of the inner roll 35.

In the above discussion only one roll is driven, preferably being the inner one. However, if desired, it is possible to drive both rolls and to avoid complications due to differences in rotational speed of the two rolls. This driving of both rolls is accomplished by directly driving one roll and by having the drive for the other roll torque-controlled and being subservient to the first drive. Another way of driving both rolls is to arrange the outer (ring) roll as a hoop nested between two or more rolls as described below. If desired, driving force can be exerted by applying tension directly to the metal itself.

As will best be seen in FIG. 1, the inner die roll 35 rotates about a first axis of rotation 42 while the die roll 30 rotates about a second axis of rotation 44 which is offset or eccentric with respect to the first axis 42. This offset or eccentricity "E" between the die rolls 30 and 35 provides a long converging throat 40 between the smooth outer contact surface 36 of the roll 35 and the smooth inner contact surface 34 of the roll 30. FIG. 1 indicates an active zone or range of convergence between the positions 46 and 48 on the opposing, smooth contact surfaces 34 and 36 with position 46 corresponding to the point where the wire 10 first contacts or strikes the opposing, smooth contact surfaces 34 and 36, and with position 48 being the point of least separation between the opposing, smooth surfaces of the rolls. This least separation between the die roll surfaces 34 and 36 is indicated by the guage dimension G.

In accordance with the present invention, the last separation G between opposing, smooth surfaces occurring at the position 48 in FIG. 1 is less than 31% of the diameter D of the wire 10, while the distance or range of convergence between positions 46 and 48 extends for at least four times the diameter D of the wire 10. Under these conditions, feeding a wire 10 through the long converging throat 40 between the rolls 30 and 35 produce a wide, flat metal strip having a width which is at least 2.5 times the original diameter D of the wire 10.

As is illustrated in FIG. 2, the flat metal strip 11 thus fabricated is removed through an exit port 17 in the vertical frame member 16. By providing the long converging throat 40 and feeding the wire 10 therethrough in the active zone or range of convergence between positions 46 and 48, the wire 10 is progressively nipped and flattened by extensive dislocation and resultant redistributing flow of the deformed metal as the metal is moved through the long converging throat moving toward the closest point of separation 48 between the two rolls. In this embodiment the redistributing flow is lateral for providing a wide strip.

It is to be understood that the metal being deformed in the long, gradually converging throat region 40 is subjected to intense pressure. Therefore, the frictional grip between the roll surfaces 34 and 36 and the metal is relatively great. The metal cannot slip or skid longitudinally in any significant proportion relative to the roll surfaces, and the two roll surfaces 34 and 36 are caused to travel at substantially the same peripheral speed even though only one of them may be driven by externally applied driving torque.

Figure 9:
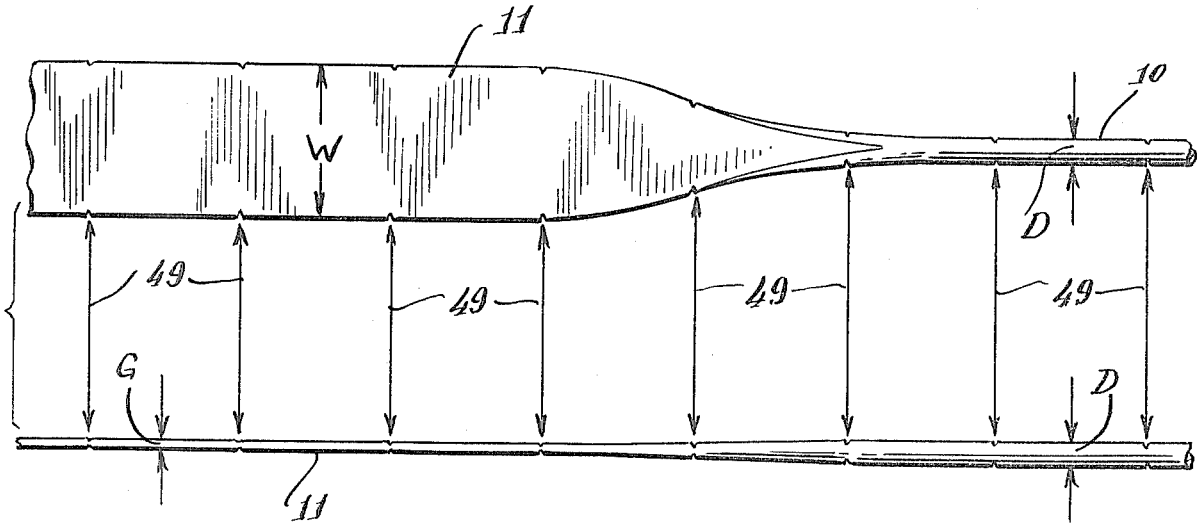
FIG. 9 shows two views of the product produced in accordance with the present invention illustrating that the widening or flattening is not accompanied by appreciable elongation.

FIG. 9 illustrates a wire 10 which is flattened into the strip 11 of the width W and gauge G in accordance with the method and apparatus of the present invention. The uniformly spaced reference arrows 49 relative to the wire and resultant strip illustrated in two planes show that the wire 10 is not significantly elongated as it passes through the long converging throat 40 toward the point of closest separation 48 between the rolls. Another way in which the lack of significant elongation can be observed is to measure the cross-sectional area of the original wire and the cross-sectional area of the resultant strip and compare them. For example, in one rolling mill such as shown in FIGS. 1 and 2, a wire of nominally pure lead having a diameter D of 0.190 of an inch was flattened into a strip having a width of approximately one inch, and a thickness of approximately 0.028 of an inch. This represents a width W to D ratio of approximately 5.3. The original cross-sectional area of the wire was very nearly the same as the final cross-sectional area of the resultant strip, indicating that very little, if any of the metal was displaced longitudinally "down the mill". (Only the very extreme front or back ends of the wire which have no forward of backward impediment, respectively, against lengthwise flow show any degree of elongation.)

The entire deformation from round wire to wide flat strip is shown as occurring in a single rolling stage. It is to be understood that in order to achieve the desired widening with reasonable pressures when tougher materials are being rolled, successive passes with less pinch per pass may be employed. Also, an apparatus with a longer converging throat in contact with the workpiece may be used so that the total pressure required for the deformation may be distributed over a larger working area thereby minimizing the unit pressure being applied to the roll contact surfaces.

The lack of significant elongation is due to the fact that the metal of the wire is laterally displaceable as it passes through the long, gradually converging throat 40, but it is restricted in the forward direction of the rotation of the rolls (longitudinally) by the preceding metal in the converging throat 40. The preceding metal in the long, gradually converging throat 40 is prevented from significant displacement longitudinally forward relative to the roll surfaces 34 and 36 by the large frictional grip occurring between these gradually converging smooth surfaces and the metal being deformed between them under great pressure. In order to prevent any significant forward displacement down the mill of the metal in the converging throat, it is preferred that the throat length be at least four times D. Therefore, the path of least resistance for deformation and flow of the metal is laterally, and accordingly, the smooth, opposing gradually converging surfaces 34 and 36 of the rolls 30 and 35, respectively, provide a strip having a width W to D ratio which is advantageously much greater than has been previously obtainable using other methods and apparatus.

The drawing shown in FIG. 9 depicts the results of flattening and greatly widening a round wire 10 of nominally pure lead having a nominal diameter D of 0.190 of an inch. The gauge thickness G of the resultant strip 11 was approximately 0.028 of an inch and its width W was approximately one inch. Here the width expansion ratio of W to D is approximately 5.3.

Figure 3:
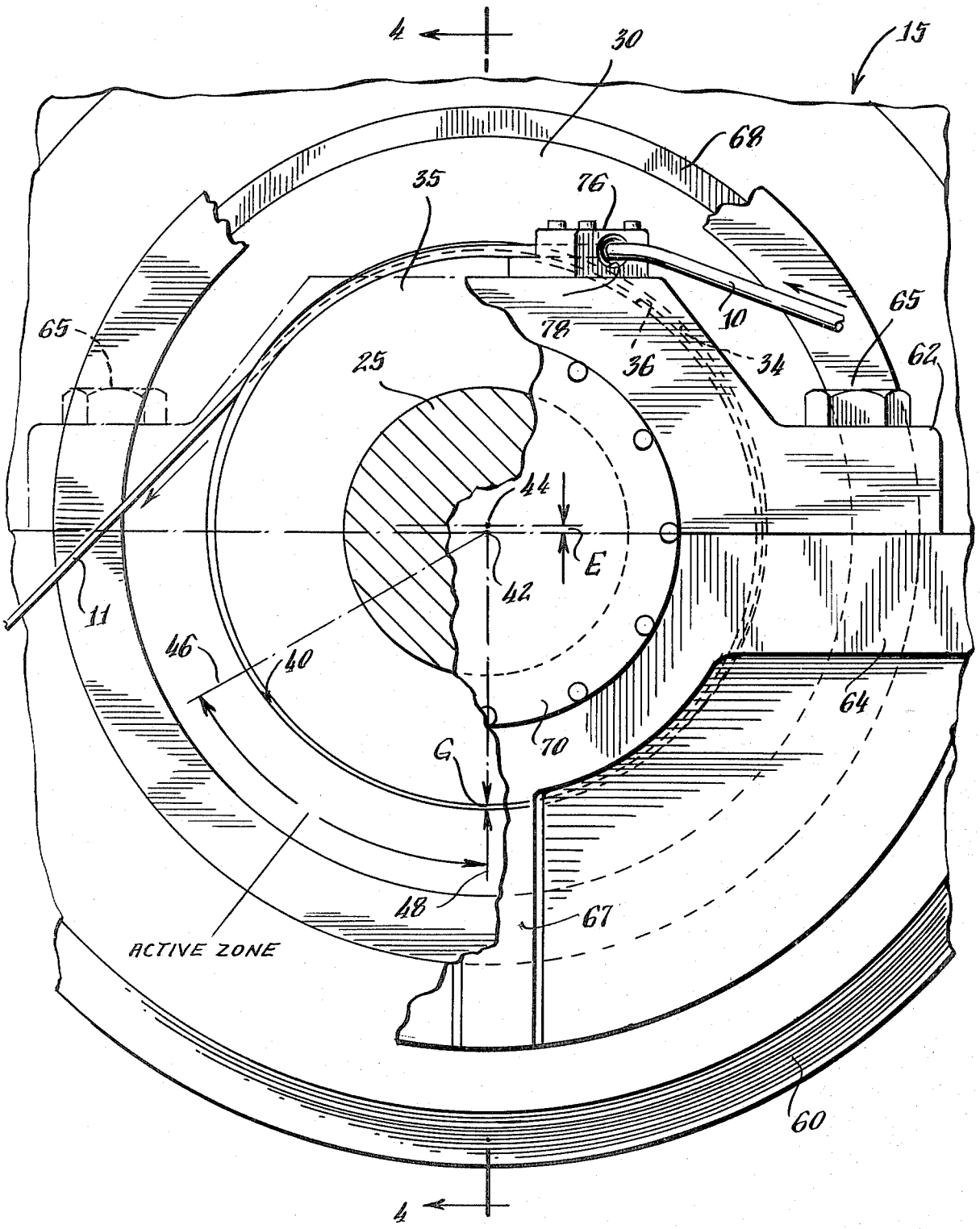
FIG. 3 is a cross-sectional view taken along line 3—3 of FIG. 4, illustrating another embodiment of this invention.
Figure 4:
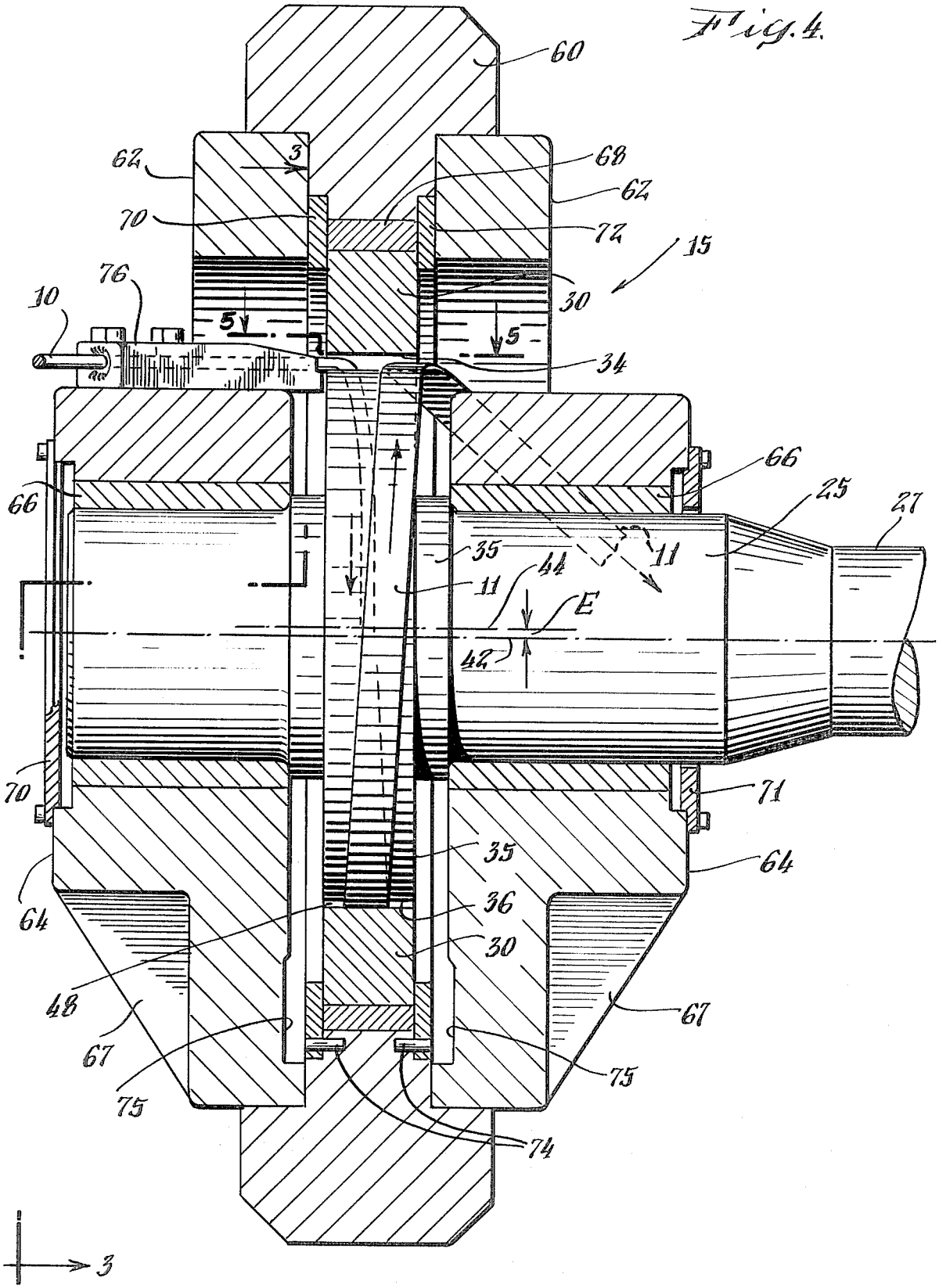
FIG. 4 is an axial sectional view taken along line 4—4 of FIG. 3.

FIGS. 3 and 4 illustrate another embodiment of the invention in which the frame 15 comprises an outer ring-shaped frame member 60, split upper and lower frame members 62 and 64, respectively, with the upper frame member 62 bolted to the lower frame member 64 by bolts 65. The upper and lower frame members 62 and 64 carry sleeve bearings 66 in which the shaft 25 of inner roll 35 rotates. A sleeve bearing 68 is positioned between the ring bearings 70 and 72 which are held against rotation relative to the frame by pins 74. The outer roll 30 is mounted in the frame 15 for rotation within sleeve bearing 68. The lower frame members 64 have strengthening ribs 67 thereon. A removable cover 70 and a removable ring-shaped cover 71 are provided on opposite sides of the frame 15 for retaining lubricant and for protecting the bearings. All of the bearings are of porous bronze construction and are impregnated with lubricating material. Also, there are well-like vertical grooves 75 provided in the interior surfaces of the lower frame members 64 for holding lubricating oil for seepage into the bearings 68, 70 and 72.

Figure 5:
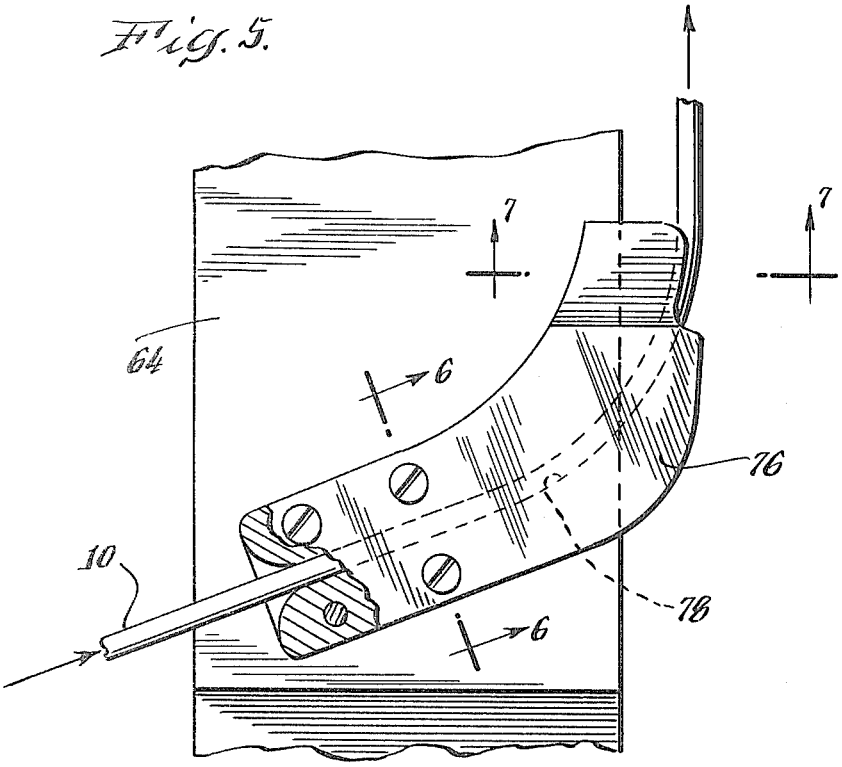
FIG. 5 is a cross-sectional view taken along line 5—5 of FIG. 4 illustrating one form of guide which may be utilized for feeding wire into the converging throat region between the rolls.
Figure 6:
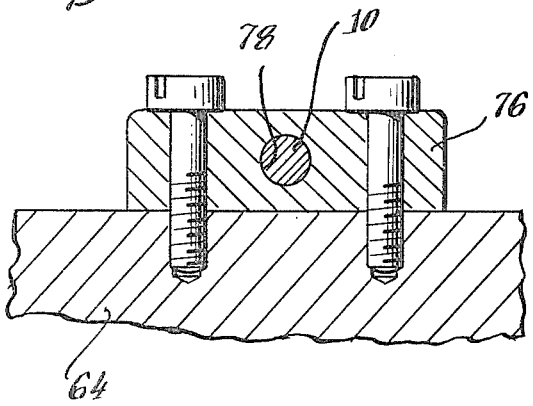
FIG. 6 is a cross-sectional view taken along line 6—6 of FIG. 5.
Figure 7:
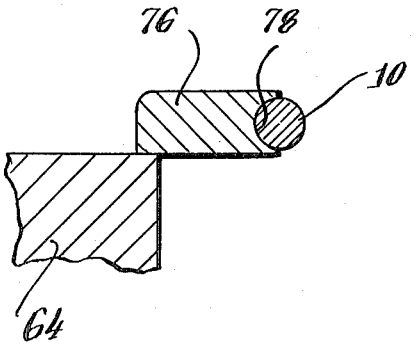
FIG. 7 is a cross-sectional view taken along line 7—7 of FIG. 5.

The wire 10 is fed through a guide 76 as best seen in FIGS. 5, 6 and 7 between the rolls 30 and 35. The guide 76 has a channel 78 therein through which the wire is fed to the long, gradually converging throat 40 which is again arranged by rotating the rolls 30 and 35 in the same direction, with the inner roll 35 having its axis of rotation 42 eccentrically positioned as indicated by "E" with respect to the axis of rotation 44 of the concave roll 30. Thus, a long, gradually converging throat 40 is defined between the opposed, smooth roll surfaces, the position of closest aproach 48 having the least separation or gauge dimension G is shown on the lower portion of the rolls in FIGS. 3 and 4.

The method of operation of the embodiment shown in FIGS. 3 and 4 is the same as that previously described with respect to the embodiment illustrated in FIGS. 1 and 2. It is to be understood that a wire guide similar to that shown in FIGS. 5–7 may also be used in connection with the embodiment of FIGS. 1 and 2.

The wire 10 is fed into the long, gradually converging throat 40 in FIG. 3 and leaves as a flat strip 11 in which W is at least 2.5 times D of the wire 10 which has been fed therein. The driving torque for turning the two rolls 30 and 35 in FIGS. 3 and 4 is preferably applied to the driving connection or coupling 27 (FIG. 4) on the shaft 25.

Figure 8:
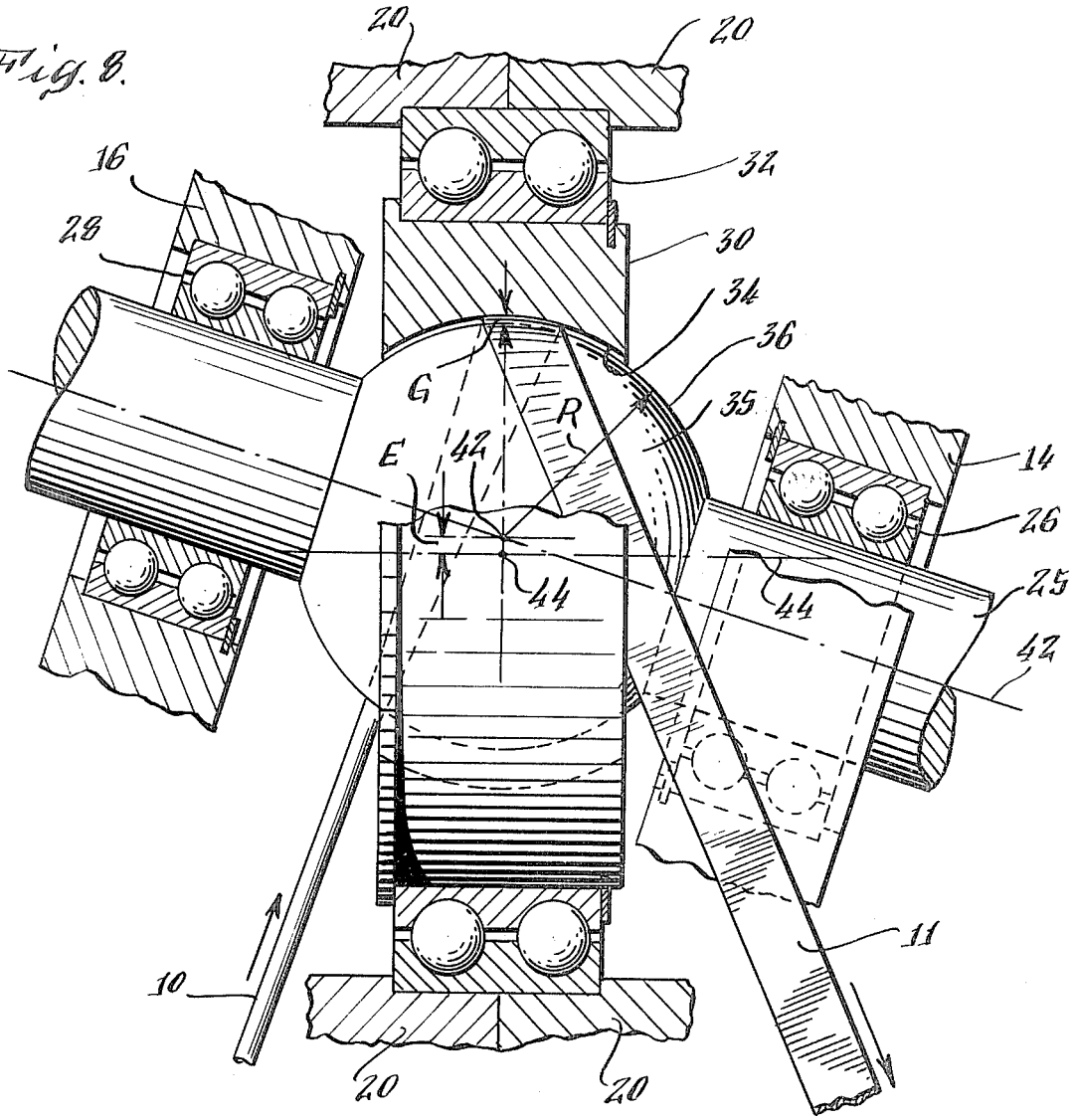
FIG. 8 is a partial axial sectional view, with portions shown in elevation, illustrating a modified form of apparatus which may be utilized in practicing the present invention.

FIG. 8 illustrates another embodiment in which the inner roll 35 has a spherically-shaped smooth, outer contact surface 36, and it is rotated about a first axis 42 by the shaft 25, while the outer roll 30 is rotatable about the second axis 44. This second axis 44 is eccentrically positioned with respect to the first axis as shown by the offset E for defining the long, gradually converging throat in the same manner as the embodiments previously described. However, in the embodiment of FIG. 8 the axis 42 is inclined relative to the axis 44 which facilitates the feeding of the wire 10 into the convergent throat as in the previous embodiments and is removable as a strip 11 therefrom. The interior smooth contact die surface 34 of the outer die roll 30 is a portion of a spherical surface having a radius of curvature which is equal to the radius of curvature R of the spherical surface 36 plus the gauge spacing G. As in the previous embodiments this gauge spacing G is the least separation between the roll surfaces 34 and 36.

Portions of the ring-shaped frame members 20 are shown holding the roller bearing 32 for the outer roll 30. Portions of the spaced frame members 14 and 16 for holding the roller bearings 26 and 28 for the shaft 25 are also shown.

In the embodiments which have been described, the outer roll 30 may be only driven by the shaft 25 which rotates the inner roll 35, when the wire 10 is inserted into the convergent throat area between the rolls and comes into contact with the smooth, opposing surfaces 34 and 36 of the rolls 30 and 35. Once the wire has finally come into contact with both roll surfaces, the roll 30 rotates in the same direction as the roll 35 and at substantially the same peripheral speed.

The rolls do not require the same width dimension. All that is essential is that the opposing surfaces of the rolls form a long, gradually converging throat of the type described with sufficient spacing and width to accommodate the feeding of the wire into the throat, and the subsequent flattening which takes place therein and the removal of the resultant strip therefrom.

If it is desired to increase the relative length of the long, gradually converging throat 40 for a given final gauge G, then the outside diameter of the surface 36 of the inner roll 35 is made more nearly equal to the inside diameter of the surface 34 of the outer roll 30, i.e. the differential in their diameters is decreased. If it is desired to provide more room for in-feeding of the wire and for removal of the strip, then the diameters of both rolls are increased, i.e. the mill is increased in overall size.

Figure 11:
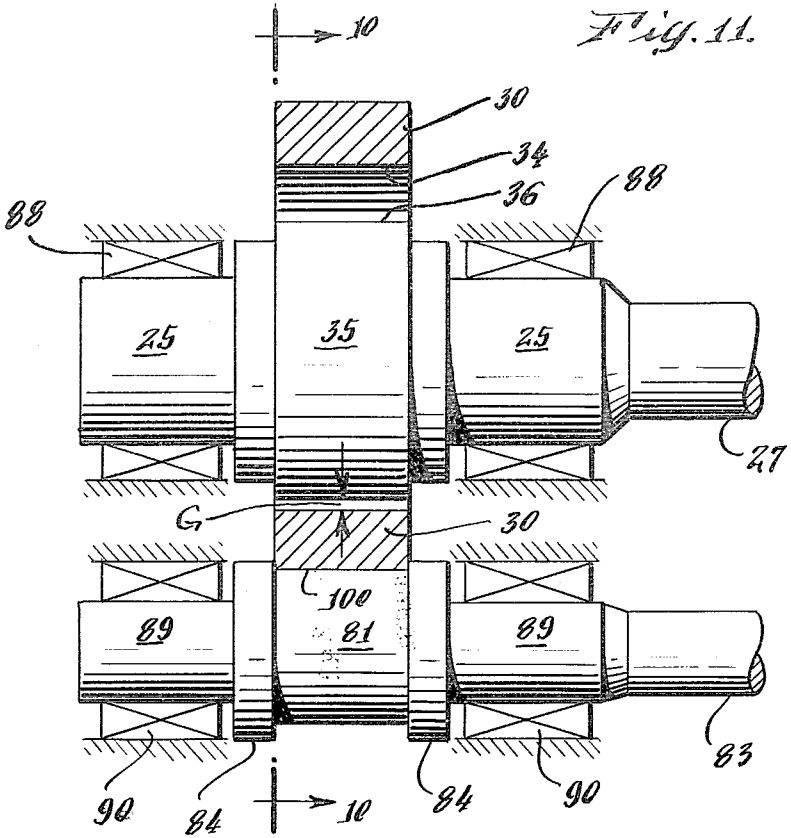
FIG. 11 is an elevational sectional view taken along the lines 11—11 in FIG. 10.
Figure 10:
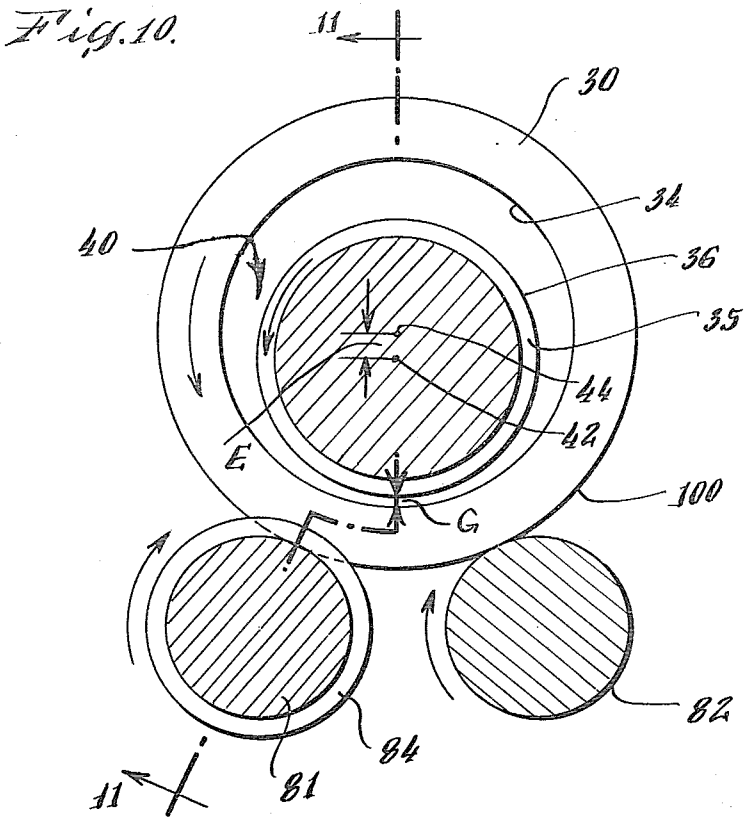
FIG. 10 is an elevational sectional view taken along the plane 10—10 in FIG. 11 and showing an embodiment of the invention in which the outer roll or die ring is a hoop entrained between three rolls.

In the embodiment shown in FIGS. 10 and 11, the outer roll 30 is in the form of a hoop captured between three rolls 35, 81 and 82. The inner roll 35 serves the same function as before, and the two companion rolls 81 and 82 entrain the hoop roll 30. Driving torque can be applied to both of the rolls 81 and 82 and also, if desired, to the inner roll 35 by means of shaft extensions 83 and 27. There are a pair of spaced shoulders 84 on at least one of these companion rolls 81 and 82 for guiding the hoop roll 30 to hold it in alignment with the inner roll 35. The shaft 25 of the inner roll is mounted in bearings 88, and the shafts 89 of each of the rolls 81 and 82 are mounted in bearings 90.

There is a long, gradually converging throat 40 defined between the smooth outside contact surface 36 of the inner roll 35 and the smooth inside contact surface 34 of the outer hoop roll 30. The position of closest spacing G between the contact surfaces 34 and 36 is less than 31% of the diameter of the wire to be rolled in the converging throat 40. Moreover, the contact length of this converging throat 40 is at least four times the diameter of the wire to be rolled.

Figure 13:
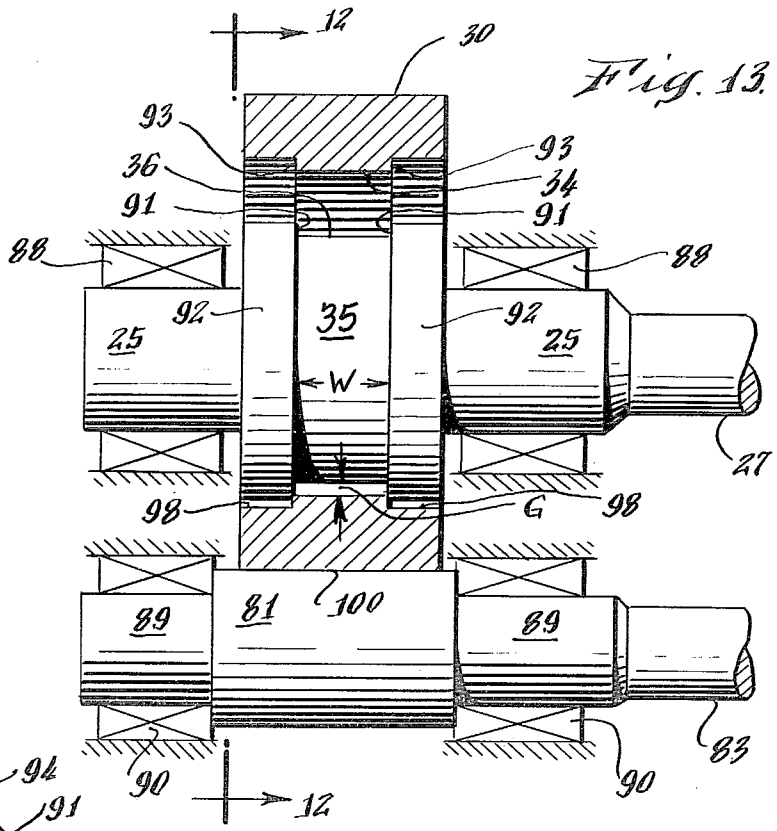
FIG. 13 is an elevational sectional view taken along the lines 13—13 in FIG. 12.
Figure 12:
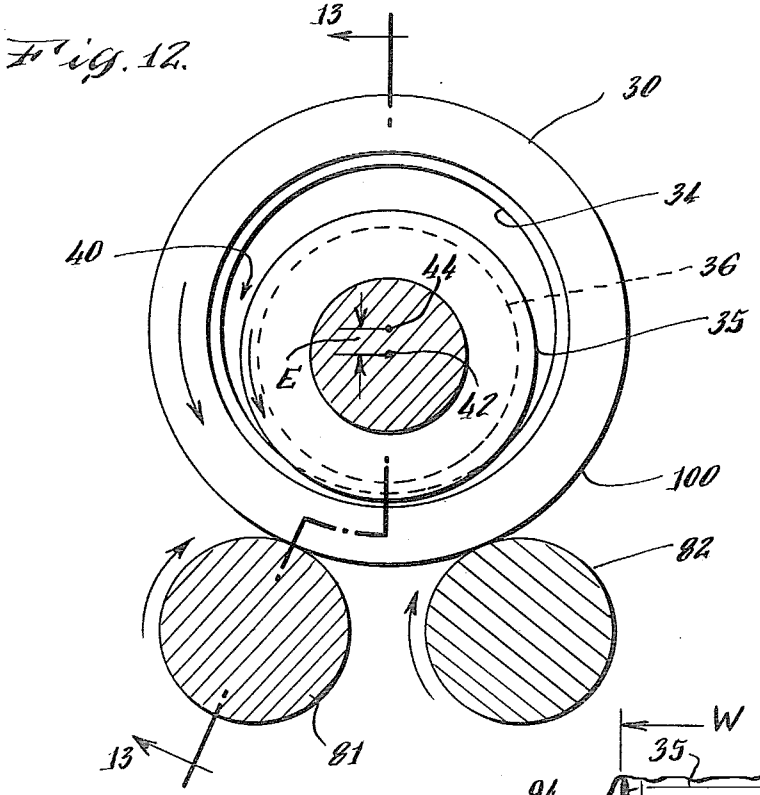
FIG. 12 is an elevational sectional view taken along the plane 12—12 in FIG. 13 and showing a further modified embodiment.

In FIGS. 12 and 13, the inner roll 35 includes a pair of spaced shoulders 92 with opposed cheeks 91 straddling its smooth contact surface 36. The outer hoop roll has a protruding inside contact surface whose side faces 93 fit snugly between the cheeks 91 of the shoulders 92. In effect, the protruding inside surface 34 of the hoop roll 30 fits between the shoulders of the inside roll 35 in a tongue and groove manner, thereby guiding the hoop roll for keeping it in alignment. The companion rolls 81 and 82 (FIGS. 12 and 13) do not need to have any guiding shoulders by virtue of the tongue and groove interaction of the hoop 30 and inside roll 5.

It is among the advantages of this tongue and groove arrangement as shown in FIG. 13 that the cheeks 91 serve to define precisely the desired width of the strip to be produced, and provide well-defined square edges on the strip. For example, these cheeks 91 may be spaced apart by a distance of 5 D for producing a strip of precisely predetermined gauge G having a width w which is five times the diameter of the wire to be rolled. In order to assure that the narrowest position G of the converging throat 40 is completely filled with displaced metal, the cross-sectional area WG of the resulting strip should be somewhat less than the original cross-sectional area of the wire $(\pi D^2)/4$. The equations for calculation are as follows:

(a) $WG<(\pi D^2)/4$
(b) $W=5\ D$ (Example)
(c) $5DG<(\pi D^2)/4$
(d) $G<(\pi D)/20=0.157\ D$
(e) $G<0.157\ D$ If the width W is intended to be 2.5 D, for example, then the above calculations would result in:

(f) $G<0.314\ D$

To the extent that there is a slight excess of metal entering the smooth throat 40, there is a slight displacement of metal "down the mill". The metal is displaced laterally until the space between the cheeks 91 is completely filled, then any remaining slight excess of metal is forced to flow longitudinally forward through the narrow gauge space G.

Figure 14:
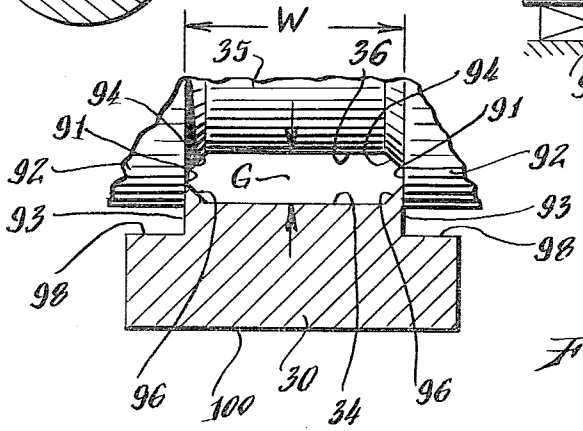
FIG. 14 is an enlarged partial sectional view illustrating a further modification of the embodiment shown in FIGS. 12 and 13.

As shown in FIG. 14, the smooth contact surface 36 of the inner roll 35 may include sloping contoured borders 94 continguous with the cheeks 91. Similarly, the protruding contact surface 34 of the hoop roll 30 may include sloping contoured borders 96 contiguous with its outer faces 93. In this manner, the resultant metal strip can be rolled with precisely shaped edge portions having a predetermined configuration.

In making calculations based upon the equations set forth above, the area occupied by the roll shapes 94 and 96 must be taken into allowance and be subtracted from the rectangular cross-sectional area WG to reach the final result. For example, if these roll shapes occupy 8% of the rectangle WG, the calculation is:

(g) $WG-0.8WG=0.92WG<(\pi D^2)/4$
(h) $W=5\ D$ (Example)
(i) $4.6\ DG<(\pi D^2)/4$
(j) $G<(\pi D)/18.4$
(k) $G<0.171\ D$ For other width to diameter ratios and for other border configuration allowances, the calculations are similarly made.

In other words, where a tongue and groove interfit relationship is provided, a strip of very accurate width and thickness (gauge) can be produced by arranging the geometric relationships such that the cross section of metal in the wire will slightly exceed the cross-sectional area of the resultant strip. Moreover, very precisely controlled edge configurations, for example, such as square or bevelled can be produced by appropriately shaping the border regions 94 and 96 of the smooth contact roll surfaces 36 and 34.

EXAMPLE 1

A nominally pure lead wire of diameter 0.190 of an inch was rolled into a strip approximately one inch wide and approximately 0.028 thick. This is a W/D ratio of approximately 5.3.

EXAMPLE 2

A lead-tin solder alloy wire of diameter approximately 0.123 of an inch was rolled into a strip of width of approximately 0.612 of an inch and a thickness of approximately 0.016 of an inch. This is a W/D ratio of approximately 5.0.

EXAMPLE 3

A nominally pure lead wire of diameter of approximately 0.240 of an inch was rolled into a strip having a width of approximately 1.31 of an inch and a thickness of approximately 0.035 of an inch. This is a W/D ratio of approximately 5.5.

In order to obtain the most precise control over the gauge thickness G of the resulting strip, in a tongue and groove roll configuration as shown in FIG. 13 or 14, it is possible to arrange for the shoulders 92 on the inner roll to be in rolling contact with the interior shoulders 98 on the outer roll. Thus, the gauge dimension G of the resultant strip is controlled solely and positively by the dimensions of the two rolls 30 and 35.

It is to be understood that in order to minimize the unit pressure being imposed upon the roll contact surfaces 34 and 36, the wire to be rolled may be pre-heated, if desired. Moreover, the rolling may be carried out at a sufficiently fast rate that the metal of the wire becomes heated up itself in temperature because of the energetic working or deformation of the metal occurring in the long converging throat 40. Both effects may also be utilized. That is, the wire may be pre-heated and then become further heated during the energetic deformation occurring in the long converging throat 40.

Although two companion rolls 81 and 82 are shown in FIGS. 10 and 12, engaging the periphery 100 of the hoop 30, it is to be understood that only one companion roll may be employed, in which event its axis is positioned in the same plane as the offset axes 42 and 44 of the rolls 35 and 30, respectively, for capturing the hoop roll between the inner roll and the single companion roll. In other words, in FIGS. 10 and 12, such a single companion roll would be positioned in contact with the periphery 100 and located directly below the axes 42 and 44.

Although the examples set forth above discuss wire of lead and of lead alloy, it is to be understood that lead and lead alloy wire were utilized to be accommodated in the prototype apparatus as a matter of convenience. It should be understood, however, that these examples are not intended to be limiting of the invention, because wire of other metals and alloys can be rolled employing the method and utilizing the apparatus embodying this invention. Wire of metal or alloy which is more difficult to deform may be rendered more ductile by heating for processing in the method and apparatus of this invention. Alternatively, sturdier rolling apparatus can be employed when it is desired to process such wire at a lower temperature.

Since other modifications and changes varied to fit particular operating requirements and environments will be apparent to those skilled in the art, the invention is not considered limited to the examples chosen for purposes of illustration and includes all equivalent modifications which do not constitute a departure from the true spirit and scope of this invention as claimed.

I claim:

1. The method of rolling a metal wire for producing a wide, flat metal strip having a width W at least 4.0 times the original diameter D of the metal wire comprising the steps of:

providing an inner roll having a smooth exterior rolling surface and rotatable about a first axis;

providing an outer roll having a smooth interior rolling surface, said outer roll being mounted around said inner roll and being rotatable about a second axis;

said outer roll being rotatable in the same direction as said inner roll and having its axis eccentrically positioned with respect to said first axis for defining a converging throat between said opposed smooth exterior and interior rolling surfaces travelling in the same direction at the same speed toward a region of closest approach between said converging rolling surfaces;

one of said rolling surfaces having a tongue configuration;

the other of said rolling surface having a groove configuration and having an axial width W between the cheeks of said groove;

said tongue rolling surface fitting snuggly into said groove at said region of closest approach;

introducing a metal wire of diameter D longitudinally into said converging throat region;

moving said wire longitudinally through said region of closest approach between said smooth converging tongue and groove rolling surfaces travelling in the same direction;

said region of closest approach between said tongue and groove rolling surface defining a rectangular opening having a cross sectional area which is somewhat less than the original cross sectional area of the wire;

said converging throat defined between said opposed smooth tongue and groove rolling surfaces travelling in the same direction extending for a longitudinal distance of at least 4 D between the point where the wire first contacts the two smooth rolling surfaces and said region of closest approach; and said metal wire being laterally displaced in said converging throat and in said region of closest approach for flattening and widening said metal wire into a wide strip having a width W at least 4.0 times the original diameter D of said wire.

2. Apparatus for rolling metal wire to produce a relatively wide, flat metal strip therefrom having a width which is at least 5 times the diameter D of the wire comprising:

an outer hollow concave roll having a smooth, inner contact surface and being rotatable about a first axis;

an inner roll mounted for rotation about a second axis eccentrically positioned with respect to said first axis and said inner roll being positioned within said outer hollow roll and having a smooth, outer contact surface forming a long, gradually converging throat with the opposed, smooth inner contact surface of said outer hollow roll;

one of said contact surfaces having a tongue configuration;

the other of said contact surfaces having a groove configuration with an axial spacing between the cheeks of said groove which is at least 5D;

said tongue fitting snuggly into said groove;

means for rotating said rolls in the same direction with said tongue and groove contact surfaces travelling at the same speed in the region of closest approach between said surfaces thereby conveying wire fed into the converging throat between the point of first contact of the wire with said opposed smooth contact surfaces and the point of closest spacing between said opposed, smooth contact surfaces;

the metal wire fed into said converging throat being laterally displaced between said point of first contact and said point of closest spacing;

said long gradually converging throat having a length between said point of first contact and said point of closest spacing which is at least four times the diameter D of the wire to be rolled; and said closest spacing between the opposed, smooth tongue and groove contact surfaces being less than 0.157 of the diameter D of the wire being fed into the converging throat;

whereby the metal wire fed into the converging throat becomes flattened and widened into a strip having a width W at least 5 times D.

3. The apparatus set forth in claim 2, in which:

means for rotating said rolls in the same direction with said tongue and groove contact surfaces travelling at the same speed in the region of closest approach between said surfaces comprises a drive means for rotating one of the rolls, while the other roll is driven by frictional contact between the metal being deformed between the smooth contact surfaces of both rolls in the log, gradually converging throat.

4. The apparatus as claimed in claim 2 in which:

means for rotating said rolls in the same direction with said tongue and groove contact surfaces travelling at the same speed in the region of closest approach between said surfaces comprises a drive means for rotating a first of the rolls; and torque-limited drive means for driving the other roll subservient to the drive means for said first roll.

5. Apparatus for rolling metal wire of initial diameter D for forming a relatively wide metal strip comprising:

an inner convex roll having a smooth exterior rolling surfaces of spherical configuration and having an axis of rotation;

said spherical convex rolling surface having a radius R;

an outer hollow concave roll having a smooth interior rolling surface of spherical configuration and having an axis of rotation;

the radius of said interior concave rolling surface of spherical configuration being larger than R;

said outer roll encircling said inner roll;

said axis of rotation of said outer roll being eccentrically positioned with respect to the axis of rotation of said inner roll for defining a long, gradually converging throat between said convex and concave rolling surfaces;

said axes of rotation being inclined one with respect to the other for facilitating the feeding of wire from one side of the two rolls into the converging throat between said convex and concave rolling surfaces; and said converging throat extending for a longitudinal distance of at least 4D from the point of initial contact between the wire and said rolling surfaces and the point of closest spacing between said rolling surfaces for providing a relatively wide metal strip.

6. Apparatus for rolling metal wire as claimed in claim 5, in which:

said outer concave roll has a smooth concave rolling surface of spherical configuration having a radius equal to R plus G;

where G is the closest separation between said smooth convex and concave spherical rolling surfaces.

7. The method of rolling a metal wire for producing a wide metal strip having a width W at least 4.0 times the original diameter D of the metal wire comprising the steps of:

providing an inner roll having a smooth exterior rolling surface and being rotatable about a first axis;

providing an outer roll having a smooth interior rolling surface, said outer roll encircling said inner roll and being rotatable about a second axis;

said outer roll being rotatable in the same direction as said inner roll with said second axis being offset from said first axis for defining a converging throat between said exterior and interior rolling surfaces travelling in the same direction toward a region of closest approach between said rolling surfaces;

interfitting said inner and outer rolls in snuggly interfitting tongue and groove relationship thereby providing a pair of spaced cheeks on the grooved one of the rolls, said cheeks being spaced apart by a distance W and straddling said region of closest approach;

in said region of closest approach said exterior and interior rolling surfaces being spaced apart by a distance G;

thereby precisely predetermining the desired width W and thickness G of the metal strip to be produced, and arranging the cross-sectional area of the space in said region of closest approach to be slightly less than the original cross-sectional area $(\pi D^2)/4$ of said wire;

thereby assuring that said region of closest approach is completely filled with metal for producing a strip of accurately predetermined dimensions having a width W at least 4.0 times the original diameter D of the metal wire.

8. The method of forming a relatively wide strip from a metal wire by rolling as claimed in claim 7, including the step of:

contouring the edge portions of the metal strip as the metal is being deformed by said rolling surfaces moving in said converging throat toward said region of closest approach between the rolling surfaces.

9. Apparatus for rolling metal wire to produce a relatively wide metal strip therefrom having a width W which is at least 4.0 times the diameter D of the wire comprising:

an outer hollow roll having a smooth, inner rolling surface and being rotatable about a first axis;

an inner roll mounted for rotation about a second axis eccentrically positioned with respect to said first axis, and said inner roll being positioned within said outer hollow roll and having a smooth, outer rolling surface forming a long, gradually converging throat with the opposed, smooth inner rolling surface of said outer roll;

said outer roll being in the form of a hoop having a periphery;

at least one companion roll positioned outside of said hoop roll and engaging the periphery of said hoop roll for capturing said hoop roll between said companion roll and said inner roll;

means for rotating said inner roll and said hoop roll in the same direction thereby moving the opposed, smooth rolling surfaces of said inner roll and hoop roll toward the point of closest spacing of said converging throat;

whereby metal wire fed into said converging throat becomes laterally displaced between the position where said wire first comes into contact with both of said smooth rolling surfaces and said point of closest spacing; and said converging throat extending for a distance in the direction of travel of said rolling surfaces from the point where said wire first comes into contact with both of said rolling surfaces to said point of closest spacing which at least is four times the diameter D of the wire to be rolled, whereby the metal wire fed into the converging throat becomes flattened and widened into a strip having a width W at least 4.0 times D.

10. The apparatus set forth in claim 9 wherein:

said long, gradually converging throat has a length between said position where the wire first comes into contact with both of said smooth surfaces and said point of closest spacing which is at least four times the diameter D of the wire to be rolled.

11. Apparatus for rolling metal wire to produce a relatively wide metal strip as claimed in claim 9, in which:

one of said rolls has a pair of spaced sholders defining a pair of inwardly facing cheeks which are axially spaced by a distance W and which straddle the smooth rolling surface of the other roll; and the other of said rolls has its smooth rolling surface interfitting snuggly between said cheeks in tongue and groove relationship at the point of closest spacing between said rolling surfaces;

thereby precisely predetermining the width W of the strip being rolled.

12. Apparatus for rolling metal wire to produce a relatively wide metal strip as claimed in claim 11, in which:

the borders of said smooth rolling surface on each roll are curved toward the borders of the smooth rolling surface of the other roll for producing a rolled strip having contoured edges.

13. Apparatus for rolling metal wire to produce a relatively wide metal strip therefrom comprising:

an outer hoop roll having a smooth, inner contact surface and being rotatable about a first axis;

an inner roll mounted for rotation about a second axis eccentrically positioned with respect to said first axis;

said inner roll being positioned within said hoop roll and having a smooth, outer contact surface forming a long, gradually converging throat with the opposed, smooth inner contact surface of said hoop roll;

means for rotating said inner roll and said hoop roll in the same direction thereby moving the opposed, smooth contact surfaces of said inner roll and hoop roll toward the point of closest spacing of said converging throat;

the distance between the point where the metal wire first is engaged by both of said contact surfaces and said point of closest spacing being at least four times D, one of said rolls having a pair of axially spaced annular shoulders defining a pair of spaced cheeks facing toward each other and straddling the smooth contact surface of the other roll;

the other of said rolls having a protruding smooth contact surface having a width for fitting closely between said cheeks in tongue and groove relationship in the region of closest spacing between said smooth contact surfaces;

whereby said spaced cheeks precisely predetermine the width of the resultant metal strip.

* * * * *